US005858124A

United States Patent [19]

Endo et al.

[11] Patent Number: 5,858,124

[45] Date of Patent: Jan. 12, 1999

[54] RARE EARTH MAGNET OF HIGH ELECTRICAL RESISTANCE AND PRODUCTION METHOD THEREOF

[75] Inventors: Minoru Endo; Mitsuaki Mochizuki; Nobuhiko Fujimori, all of Kumagaya, Japan

[73] Assignee: Hitachi Metals, Ltd., Tokyo, Japan

[21] Appl. No.: 740,491

[22] Filed: Oct. 30, 1996

[30] Foreign Application Priority Data

Oct. 30, 1995 [JP] Japan ..... 7-305087
Aug. 23, 1996 [JP] Japan ..... 8-241101

[51] Int. Cl.[6] ..... H01F 1/055; H01F 1/057

[52] U.S. Cl. ..... 148/302; 148/301; 148/104; 148/101; 95/230; 95/232; 419/10; 419/12; 419/19

[58] Field of Search ..... 148/301, 302, 148/303, 104, 101; 75/230, 232; 419/19, 10, 12

[56] References Cited

U.S. PATENT DOCUMENTS

| | | | |
|---|---|---|---|
| 4,601,754 | 7/1986 | Ghandehari | 148/301 |
| 4,891,078 | 1/1990 | Ghandehari | 148/301 |
| 4,983,231 | 1/1991 | Yamanka et al. | 148/301 |

FOREIGN PATENT DOCUMENTS

| | | |
|---|---|---|
| 4125907 | 4/1992 | Japan . |
| 5121220 | 5/1993 | Japan . |

*Primary Examiner*—John Sheehan
*Attorney, Agent, or Firm*—Sughrue, Mion, Zinn, Macpeak & Seas, PLLC

[57] ABSTRACT

A high-resistance rare earth magnet having a metal structure in which a rare earth magnet phase is dispersed throughout a compound phase comprising at least one compound selected from the group consisting of fluorides and oxides of Li, Na, Mg, Ca, Ba and Sr. The fluorides and oxides are effective for increasing the electrical resistance of a rare earth magnet to a level sufficient for practical use while maintaining high magnetic properties of the magnet.

21 Claims, 2 Drawing Sheets

25 μm

200 μm

RARE EARTH MAGNET OF HIGH ELECTRICAL RESISTANCE AND PRODUCTION METHOD THEREOF

BACKGROUND OF THE INVENTION

The present invention relates to a rare earth permanent magnet for use in rotary equipments, electronic parts or components, electronic equipments, etc.

A ferrite magnet has been widely used in a permanent magnet rotary equipment due to its low cost. However, a rare earth magnet has recently come to be used in place of the ferrite magnet to meet the recently increasing demand for reducing the size and improving the efficiency of the rotary equipment. For example, an Sm—Co magnet having a good heat stability and corrosion resistance and a high-performance Nd—Fe—B magnet are used depending on the application use. Of the Sm—Co magnets, $Sm_2Co_{17}$ magnet is advantageous because the properties thereof is not deteriorated by machining and the protective coating is practically not necessitated. Formerly, the maximum energy product, (BH)max, of the Nd—Fe—B magnet was about 35 MGOe at most. However, at present the (BH)max of the Nd—Fe—B magnet has reached 40–45 MGOe. In addition, although the former Nd—Fe—B magnet involved a problem of insufficient heat resistance, this heat resistance has been improve to a certain extent in some application use.

However, the Nd—Fe—B magnet still involves various disadvantages to be removed in view of practical use, such as a large thermal coefficient of the residual magnetic flux density (Br) and the coercive force (iHc), a low Curie temperature, unavoidable protective coating of the magnet surface and a low electrical resistance.

Of the above disadvantages, the low electrical resistance is the most difficult one to be solved because the rare earth magnet comprises electrical conductive metallic substances. If the electrical resistance is low, the rare earth magnet generates a large amount of heat due to eddy current to reduce the efficiency of a rotary equipment such as a motor, when used under a condition in which the amount of magnetic flux changes periodically. Although it is difficult to increase the electrical resistance of a metallic substance, it has been expected that the application field of the rare earth magnet can be more expanded if the electrical resistance thereof is increased. To increase the electrical resistance of a magnet made of a metallic material, JP-A-4-125907 teaches to deposit by sputtering an insulating thin film such as $SiO_2$ film on fine powder of a metal such as Fe—Co alloy, and sinter the resultant powder. JP-A-5-121220 teaches to coat a resin-bonded magnet powder with an inorganic binder by sol-gel method and subject the resultant powder to a direct compacting in a molding die while passing electrical current, thereby producing a full density magnet. However, the characteristics of the rare earth magnets reported therein are still insufficient and necessary to be further improved.

OBJECT AND SUMMARY OF THE INVENTION

Accordingly, an object of the present invention is to provide a high electrical resistance rare earth magnet simultaneously satisfying the requirements of a high electrical resistance and high magnetic properties, and a production method thereof.

The inventors have made extensive studies on various borides, carbides, nitrides, oxides and fluorides, and as a result thereof, have found that the fluorides and oxides of Li, Na, Ma, Ca, Ba and Sr allow the magnet phase of the R—Co magnet or R—Fe—B magnet to be dispersed therein without reacting the magnet, thereby increasing the electrical resistance of the rare earth magnet. The present invention has been accomplished based on this finding.

Thus, in a first aspect of the present invention, there is provided a high-resistance rare earth magnet having a metal structure in which a rare earth magnet phase is dispersed throughout a compound phase comprising at least one compound selected from the group consisting of fluorides and oxides of Li, Na, Mg, Ca, Ba and Sr.

In a second aspect of the present invention, there is provided a production method of the high-resistance rare earth magnet as defined above.

Figure 1:
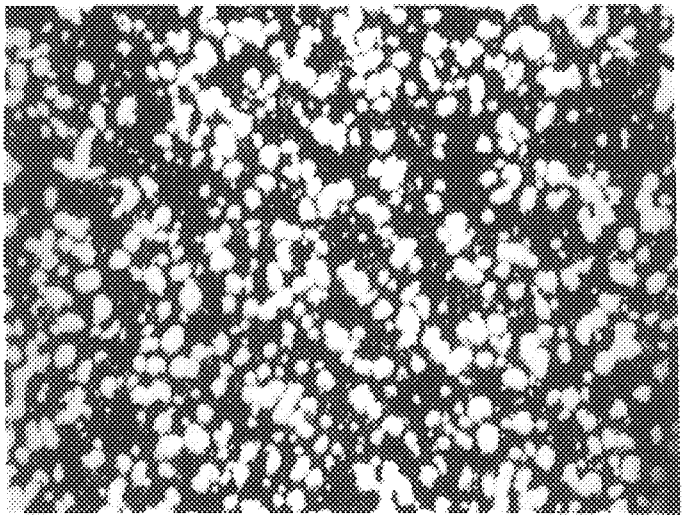
FIGS. 1 to 3 are electron microscopic photographs each showing the metal structure of the high electrical resistance rare earth magnet of the present invention.

DETAILED DESCRIPTION OF THE INVENTION (a) Magnet Forming Rare Earth Magnet Phase The magnet forming a rare earth magnet phase of the rare earth magnet of high electrical resistance according to the present invention is preferably an R—Fe—B-based magnet or an R—Co-based magnet, wherein each R is at least one rare earth element including Y (yttrium).

The R—Fe—B-based magnet comprises 10–40 weight % of R, 0.5–5 weight % of B (boron) and a balance of Fe, the weight percentage being based on the total amount of the R—Fe—B-based magnet. Nd, Pr and Dy are preferred elements for the R, and Nd is particularly preferable. Further, it is preferred to use Dy up to 50 weight %, preferably up to 30 weight % of the total amount of R in view of improving the coercive force and reducing the production cost.

The R—Fe—B-based magnet may contain optional elements such as Co, Nb and M representing at least one of Al, Ga and Cu. Co improves the corrosion resistance and heat stability, and may be added up to 25 weight % based on the total amount of the R—Fe—B-based magnet. An addition amount exceeding 25 weight % unfavorably reduces the residual magnetic flux density and coercive force. Nb is effective for preventing the overgrowth of crystal and enhancing the heat stability. Since an excess amount of Nb reduces the residual magnetic flux density, Nb is preferred to be added up to 5 weight % based on the total amount of the R—Fe—B-based magnet. Although M is effective for enhancing the coercive force, an excess amount of M reduces the residual magnetic flux density. Therefore, M is added in amount of 0.01–2 weight % in total based on the total amount of the R—Fe—B-based magnet.

The R—Co-based magnet comprises 10–35 weight % of R, 30 weight % or less of Fe, 1–10 weight % of Cu, 0.1–5 weight % of M' representing at least one of Ti, Zr and Hf, and a balance of Co, each weight percentage being based on the total amount of the R—Co-based magnet. The R—Co-based magnet is preferred to have $R_2Co_{17}$ crystal structure.

In the R—Co-based magnet, the rare earth element R, together with Co, forms the $R_2Co_{17}$ crystal structure which is responsible for the magnetism, and R is preferred to consist of Sm and at least one of Ce, Pr and Gd. When the amount of R is lower than 10 weight %, the coercive force and the squareness ratio are low, and the residual magnetic flux density is reduced when exceeds 35 weight %. Although a high Br can be achieved by the addition of Fe, a sufficient coercive force cannot be obtained when the amount exceeds 30 weight %. It is preferable to add Fe at least 5 weight % in view of improving Br. Cu contributes to improving the coercive force. However, the addition of less than 1 weight % shows no improving effect, and the residual magnetic flux density and coercive force are reduced when added exceeding 10 weight %. M' promotes the generation of $TbCu_7$ type crystalline structure corresponding to $(R, Zn)(Fe, Co, Cu)_7$ after solution treatment, however, an excess amount of M' reduces the residual magnetic flux density.

The R—Fe—B-based magnet and R—Co-based magnet used in the present invention may include inevitable impurities such as C, N, O, Al, Si, etc. in an amount usually contained.

(b) Compound Forming Compound Phase

The compound forming a compound phase of the rare earth magnet of high electrical resistance according to the present invention, which contributes to increasing the electrical resistance of rare earth magnet, may include fluorides and oxides of Li, Na, Mg, Ca, Ba and Sr. The above resistance-increasing compound may be used alone or in combination of two or more. Fluorides of Li, Na, Mg, Ca, Ba and Sr, particularly fluorides of Ca and Sr are preferable for increasing the electrical resistance of an R—Fe—B-based magnet because of the low reactivity of the fluorides and the R—Fe—B-based magnet. The preferred resistance-increasing compound for the R—Co-based magnet may include $CaF_2$, $SrF_2$ and CaO. The average particle size of the resistance-increasing compound to be mixed with the magnet powder is 100 $\mu$m or less, preferably 0.1 to 10 $\mu$m. To attain a well-balanced magnetic properties and a high electrical resistance, the resistance-increasing compound may be mixed with the magnet powder in a ratio of 1–50% by weight, preferably 10–40% by weight based on the total amount of the resistance-increasing compound and the R—Fe—B-based magnet powder or the R—Co-based magnet powder. When the ratio is less than 1 weight %, the electrical resistance cannot be sufficiently increased, and the magnetic properties are deteriorated when the ratio exceeds 50 weight %.

The high resistance rare earth magnet of the present invention may contain wollastonite, $Al_2O_3$, $SiO_2$, AlN, $Si_3N_4$ and SiC in addition to the resistance-increasing compound.

(c) Production Method

The rare earth magnet of high electrical resistance according to the present invention may be produced by mechanically mixing the powder of rare earth magnet and at least one of the resistance-increasing compound, compacting the mixture, and heat-sintering the compact. The rare earth magnet of high electrical resistance may be also produced by spark plasma sintering of the powder mixture. Further, the powder mixture may be densified by hot press, HIP, extrusion or upsetting work to obtain the rare earth magnet of high electrical resistance.

The R—Fe—B-based magnet powder for heat-sintering without passing electrical current through the powders to be sintered may be prepared by coarsely pulverizing an R—Fe—B ingot produced by melting and casting the starting material in a disk mil, Brawn mil, etc., and then finely pulverizing in a jet mil, ball mil, etc. to particles having an average size of 1–10 $\mu$m, preferably 3–6 $\mu$m. The R—Fe—B-based magnet powder and at least one resistance-increasing compound are mechanically mixed with each other. The powder mixture is compacted under a pressure of 500–3000 kgf/cm$^2$ in a magnetic field of 1–20 kOe to obtain a green body, which is then sintered at 1000°–1150° C. for 1–4 hours in vacuo or in an inert gas atmosphere such as Ar atmosphere. The sintered product may be further heat-treated at 450°–900° C. for 1–4 hours to obtain a rare earth magnet of high electrical resistance.

The R—Fe—B-based magnet powder for spark plasma sintering, hot press and HIP may be a magnetically isotropic or anisotropic powder having an average particle size of 1–500 $\mu$m. The magnetically isotropic powder may be produced by a super quenching method, and has a metal structure comprising $R_2Fe_{14}B$ phase and R-rich phase; $\alpha$-Fe phase and $R_2Fe_{14}B$ phase; or $Fe_3B$ phase and $R_2Fe_{14}B$ phase. The R—Fe—B-based magnet powder having any of these metal structures may be usable. The magnetically anisotropic powder may be obtained by hydrogen occlusion of an R—Fe—B alloy and a subsequent dehydrogenation, or by heat-densifying a super-quenched R—Fe—B alloy powder, upsetting the densified powder, and pulverizing the upset powder. The magnetically isotropic or anisotropic powder thus obtained is mechanically mixed with at least one resistance-increasing compound. The powder mixture may be compacted to a green body, prior to being subjected to the spark plasma sintering, hot press or HIP, under a pressure of 300–6000 kgf/cm$^2$ in the absence of external magnetic field for the isotropic powder or under the influence of an external magnetic field of 1–20 kOe for the anisotropic powder. The green body is subjected to a spark plasma sintering, hot press or HIP to obtain the rare earth magnet of high electrical resistance according to the present invention with or without after-heat treatment at 400°–700° C. for 1–5 hours.

In the spark plasma sintering, a DC pulse current of 200–1000 A is passed through the green body at 20–80 V for 5–90 seconds in a vacuo of $10^{-7}$ to 1 Torr while applying a compressive pressure of 100–500 kgf/cm$^2$ to generate spark plasma between the powder particles. After the generation of spark plasma, the green body is sintered at 600°–1000° C. for 100–1000 second under a pressure of 100–5000 kgf/cm$^2$ while allowing a DC current of 50–1000 A to pass through the green body. The spark plasma locally creates a high temperature region and activates the particle surface. Since the resistance-increasing compound has a high electrical resistance, the powder particles thereof are preferentially heated by Joule heat. This promotes the sintering and prevents the magnet powder from overgrowing to finely and uniformly disperse the magnet phase throughout the compound phase.

The hot press is conducted at 600°–1000° C. for 1–10 hours under a pressure of 500–6000 kgf/cm$^2$.

The HIP is conducted at 600°–1000° C. for 1–10 hours under a pressure of 500–2000 kgf/cm$^2$.

The R—Fe—B-based magnet powder for upsetting work or extrusion may be obtained by super-quenching a molten R—Fe—B alloy and pulverizing the resultant flake-shaped alloy to an average particle size of 0.05–1 mm. The magnet powder is then mechanically mixed with at least one resistance-increasing compound, and compacted at 600°–1000° C. under 300–2000 kgf/cm$^2$ to form a green body, which is then subjected to upsetting work or extrusion at 600°–1000° C.

The R—Co-based magnet powder may be obtained by a melting method or a reductive diffusion method.

In the melting method, the alloying metals such as R, Co, Fe, Cu, Ti, Zr and Hf are melted by a high-frequency melting or an arc melting and cooled to obtain an ingot. After subjected to a solution treatment at 1000°–1250° C. for 4–48 hours and a subsequent aging treatment at 600°–900° C. for 4–48 hours, if desired, the ingot is pulverized to obtain an R—Co-based magnet powder having an average particle size of 4–500 μm. The R—Co-based magnet powder thus obtained is mechanically mixed with at least one resistance-increasing compound, and is compacted under a pressure of 500–8000 kgf/cm$^2$ in a magnetic field of 1–20 kOe to obtain a green body, which is then subjected to the heat-sintering, spark plasma sintering, hot press or HIP in the same manner as described above and optionally subjected to a solution treatment at 1000°–1220° C. for 4–48 hours and an aging treatment at 650°–900° C. for 4–48 hours to obtain the rare earth magnet of high electrical resistance according to the present invention.

In the reductive diffusion method, rare earth fluorides such as $SmF_3$, $CeF_3$, $CeF_4$, $PrF_3$, $NdF_3$, etc. or rare earth oxides such as $Sm_2O_3$, $CeO_2$, $Pr_2O_3$, $Nd_2O_3$, etc. are mechanically mixed, for example, with Co powder, iron carbonyl powder, Cu powder, Cu—Zr powder, $ZrO_2$ powder, metals or hydrides of Na, Mg and Ca, and optionally fluorides of Li, Na, Mg, Ca, Ba and Sr. The powder mixture is heated at 900°–1300° C. for 2–10 hours in an inert gas atmosphere such as Ar gas to reduce the rare earth fluorides or the rare earth oxides to obtain an alloy. The alloy is pulverized to particles having an average size of 10–500 μm and then further mechanically mixed with an amount of the resistance-increasing compound to regulate the content of the resistance-increasing compound. In addition to the resistance-increasing compound powder, powder of wollastonite, oxide or nitride of Al and Si and SiC may be used. The powder mixture is then subjected to compacting and heat-sintering, spark plasma sintering, hot press or HIP in the same manner as described above.

In the rare earth magnet of high electrical resistance thus produced, the rare earth magnet phases having an average diameter of 1–500 μm are dispersed throughout the compound phase formed from the resistance-increasing compound. The ratio of the dispersed rare earth magnet phase is preferably 40–90 vol. % based on the total the magnet phase and the compound phase.

The present invention will be further described while referring to the following Examples which should be considered to illustrate various preferred embodiments of the present invention.

EXAMPLE 1

An alloy having a chemical composition of $Nd_{24.0}Pr_{7.0}Dy_{3.0}Fe_{bal}Co_{2.5}B_{1.0}Al_{0.2}Ga_{0.1}Cu_{0.06}$ (weight %) produced by high-frequency melting method was coarsely pulverized to a particle size of 0.5 mm or less. The coarse powder was finely pulverized in a jet mil to obtain an R—Fe—B magnet powder having an average particle size of 4.5 μm. The R—Fe—B magnet powder was mixed with $CaF_2$ powder having an average particle size of 0.5 μm in a mixing ratio of 50:50 by weight. After mechanically mixing, the resultant mixture was compacted under a pressure of 1500 kgf/cm$^2$ while applying a transverse orientation field of 10 kOe to produce a green body, which was then sintered at 1100° C. for 2 hours in vacuo. The sintered product was further subjected to two-stage heat treatment at 900° C. for 2 hours and at 480° C. for 2 hours to obtain a high-resistance rare earth magnet.

The magnetic properties (Br and iHc) of the high-resistance rare earth magnet was measured by a B-H tracer after magnetizing it by a magnetic field of 40 kOe. The electrical resistivity (Ω.cm) was measured by a 4-terminal DC electrical resistance meter. The results are shown in Table 1.

TABLE 1

| Compound | Br (kG) | iHc (kOe) | Resistivity (Ω · cm) |
|---|---|---|---|
| $CaF_2$ | 4.0 | 18.3 | $6.0 \times 10^{-3}$ |

Since an Nd—Fe—B sintered magnet subjected to heat treatment usually has a resistivity of 140–160 μΩ.cm, it has been confirmed that a high electrical resistance can be attained by the present invention. In addition, it has been confirmed that the high-resistance rare earth magnet of the present invention is superior particularly in coercive force as compared with a known ferrite magnet which has an Br of about 4 kG and an iHc of about 4 kOe.

An electron microscope photograph showing the metal structure of the high-resistance rare earth magnet is shown in FIG. 1. In FIG. 1, the black background is the compound phase and the white portions are the magnet phases. It can be seen that the white magnet phases having a particle size of 3–10 μm are well dispersed throughout the black compound phase.

EXAMPLE 2

By repeating the procedures of Example 1 except for adding the resistance-increasing compound in an amount shown in Table 2, each high-resistance rare earth magnet was produced. The magnetic properties and the resistivity thereof are shown in Table 2.

TABLE 2

| Compound | Addition Amount (weight %)* | Br (kG) | iHc (kOe) | Resistivity (Ω · cm) |
|---|---|---|---|---|
| MgO | 10 | 9.2 | 20.2 | $3.50 \times 10^{-4}$ |
| MgO | 30 | 4.8 | 19.6 | $9.50 \times 10^{-4}$ |
| MgO | 50 | 1.2 | 18.4 | $4.57 \times 10^{-3}$ |
| CaO | 10 | 8.8 | 19.8 | $3.90 \times 10^{-4}$ |
| CaO | 30 | 4.4 | 19.2 | $1.02 \times 10^{-3}$ |
| CaO | 50 | 2.0 | 18.2 | $5.82 \times 10^{-3}$ |
| $MgF_2$ | 20 | 5.5 | 19.6 | $5.60 \times 10^{-4}$ |
| $MgF_2$ | 40 | 2.7 | 19.0 | $1.48 \times 10^{-3}$ |
| $CaF_2$ | 20 | 6.8 | 18.9 | $4.40 \times 10^{-4}$ |
| $CaF_2$ | 40 | 4.2 | 18.4 | $3.50 \times 10^{-3}$ |
| NaF | 20 | 7.0 | 18.8 | $5.00 \times 10^{-4}$ |
| NaF | 40 | 3.4 | 18.6 | $4.65 \times 10^{-3}$ |
| $BaF_2$ | 10 | 8.8 | 17.9 | $2.90 \times 10^{-4}$ |
| $BaF_2$ | 30 | 4.7 | 16.7 | $1.10 \times 10^{-3}$ |
| $SrF_2$ | 10 | 8.5 | 17.7 | $3.80 \times 10^{-4}$ |
| $SrF_2$ | 30 | 4.0 | 17.3 | $1.62 \times 10^{-3}$ |

Note: *) Based on the total of the magnet powder and the resistance-increasing compound powder.

The magnet containing MgO or CaO was somewhat brittle because MgO and CaO react with moisture in air to form hydroxides. However, NaF, $BaF_2$, $CaF_2$ and SrF were confirmed not to react with moisture in air and to give a stable magnet. In particular, $CaF_2$ and SrF were found to be the most suitable for providing a rare earth magnet with a high electrical resistance.

EXAMPLE 3

A molten alloy having a composition of $Nd_{12.0}Fe_{bal}Co_{7.0}B_{5.8}Al_{0.8}Ga_{0.5}Cu_{0.5}$ by atomic % ($Nd_{27.1}Fe_{bal}Co_{6.5}B_{1.0}Al_{0.3}Ga_{0.5}Cu_{0.5}$ by weight %) obtained by a high-frequency melting was injected from a nozzle of 0.8 mm width and 20 mm length on the surface of roll rotating at a speed of 30 m/s to solidify the molten alloy. The solidified alloy was pulverized to a particle size of 300 μm or less, thereby obtaining a super-quenched magnet powder comprising $R_2Fe_{14}B$ phase and R-rich phase. The magnet powder was mixed with $CaF_2$ powder as the resistance-increasing compound in a weight ratio of 80:20. The powder mixture was then subjected to hot press at 850° C. for 0.5 hours under a pressure of 1000 kgf/cm$^2$ to produce a high-resistance rare earth magnet.

Separately, the same magnet powder was subjected to spark plasma sintering. After the powder mixture was introduced into a graphite mold, the atmosphere in the system was evacuated to $10^{-3}$ Torr. Then, a pulse current (750 A) was allowed to pass through the powder mixture for 90 seconds at 40 V to activate the powder particles by causing discharge. The activated powder was sintered at 700° C. for 240 seconds under 500 kgf/cm$^2$ while passing a DC current of 400 A therethrough to obtain another high-resistance rare earth magnet. The magnetic properties and resistivity of each high-resistance rare earth magnet are shown in Table 3.

TABLE 3

| Production Method | Br (kG) | iHc (kOe) | Resistivity (Ω · cm) |
|---|---|---|---|
| Hot press | 6.3 | 8.3 | $0.86 \times 10^{-2}$ |
| Spark plasma sintering | 6.8 | 11.2 | $2.0 \times 10^{-2}$ |

As seen from Table 3, the spark plasma sintering provides a high magnetic properties and a high resistivity as compared with the hot press. This may be presumed as follows. In the hot press, both the magnet powder and the fluoride powder are heated to the same temperature. On the other hand, in the spark plasma sintering, the fluoride powder is preferentially heated by Joule heat because the electrical conductivity of the fluoride powder is far smaller that that of the magnet powder. The preferential heating of the fluoride powder reduces the time required for completing the sintering, and prevents the magnet powder from overgrowing to provide a densified product.

EXAMPLE 4

From an alloy having a composition of $Nd_{13.3}Fe_{bal}Co_{10}B_{6.0}Al_{0.8}Ga_{0.5}CuO_{0.5}$ by atomic % ($Nd_{29.4}Fe_{bal}Co_{9.0}B_{1.0}Al_{0.3}Ga_{0.5}Cu_{0.5}$ by weight %), a super-quenched magnet powder comprising $R_2Fe_{14}B$ phase and R-rich phase was prepared in the same manner as in Example 3. 85 parts by weight of he magnet powder was mixed with 15 parts by weight of a mixture of resistance-increasing compounds consisting of 50 weight % of $MgF_2$, 46 weight % of $CaF_2$, 2 weight % of LiF and 2 weight % CaO. After compacting the powder mixture at 850° C. under a pressure of 2000 kgf/cm$^2$, the compacted body was subjected to an upsetting work or extrusion at 850° C. to produce each high-resistance rare earth magnet. The magnetic properties and resistivity of each high-resistance rare earth magnet are shown in Table 4.

TABLE 4

| Production Method | Br (kG) | iHc (kOe) | Resistivity (Ω · cm) |
|---|---|---|---|
| Upsetting work | 9.8 | 6.8 | $1.8 \times 10^{-3}$ |
| Extrusion | 8.6 | 7.5 | $1.4 \times 10^{-3}$ |

EXAMPLE 5

A molten alloy having a composition of $Nd_{7.0}Fe_{bal}Co_{7.0}B_{19.0}Al_{0.8}Ga_{0.5}Cu_{0.5}$ by atomic % ($Nd_{18.8}Fe_{bal}Co_{7.7}B_{3.8}Al_{0.4}Ga_{0.7}Cu_{0.6}$ by weight %) obtained by a high-frequency melting was injected from a nozzle of 0.6 mm width and 20 mm length on the surface of roll rotating at a speed of 45 m/s to solidify the molten alloy. The solidified alloy was pulverized to a particle size of 200 μm or less, thereby obtaining a super-quenched magnet powder comprising $R_2Fe_{14}B$ phase and $Fe_3B$ phase. 75 parts by weight of the magnet powder was mix with 25 parts by weight of a mixture of resistance-increasing compounds consisting of 45 weight % of $MgF_2$, 45 weight % of $CaF_2$ and 10 weight % of LiF. The resultant powder mixture was subjected to a hot press at 900° C. for 1 hour under 3000 kgf/cm$^2$ to produce a high-resistance rare earth magnet. Separately, the same powder mixture was subjected to a spark plasma sintering in the same manner as in Example 3 except for changing the sintering temperature to 800° C. to produce another high-resistance rare earth magnet. The magnetic properties and resistivity are shown in Table 5.

TABLE 5

| Production Method | Br (kG) | iHc (kOe) | Resistivity (Ω · cm) |
|---|---|---|---|
| Hot press | 8.2 | 5.3 | $2.0 \times 10^{-2}$ |
| Spark plasma sintering | 8.8 | 7.5 | $3.0 \times 10^{-2}$ |

EXAMPLE 6

A molten alloy having a chemical composition of $Nd_{14.0}Fe_{bal}Co_{2.0}B_{6.0}Al_{0.8}Ga_{0.1}Cu_{0.1}$ by atomic % ($Nd_{30.8}Fe_{bal}Co_{1.8}B_{1.0}Al_{0.3}Ga_{0.1}Cu_{0.1}$ by weight) obtained by a high-frequency melting method was super-quenched, and the resulting alloy was coarsely pulverized to a particle size of 500 μm or less. The coarse powder was finely pulverized in a jet mil to 4–5 μm to obtain a super-quenched R—Fe—B magnet powder comprising $R_2Fe_{14}B$ phase and R-rich phase. A mixture of 83 parts by weight of the magnet powder and 17 parts by weight of $CaF_2$ powder was compacted to form a cylindrical green body of 20 mm diameter and 15 mm thickness while applying a longitudinal field of 15 kOe. The green body was introduced into a graphite mold and subjected to a hot press at 800° C. for 1 hour under 3000 kgf/cm$^2$. The resultant product was heat-treated at 400°–700° C. to produce a high-resistance rare earth magnet. Separately, the same greed body was subjected to a spark plasma sintering in the same manner as in Example 3 except for changing the sintering temperature to 800° C. The sintered product was further subjected to heat treatment at 400°–700° C. to produce another high-resistance rare earth magnet. The magnetic properties and resistivity are shown in Table 6.

TABLE 6

| Production Method | Br (kG) | iHc (kOe) | Resistivity (Ω · cm) |
|---|---|---|---|
| Hot press | 8.2 | 7.3 | $1.8 \times 10^{-3}$ |
| Spark plasma sintering | 8.1 | 16.5 | $3.1 \times 10^{-3}$ |

EXAMPLE 7

An Nd—Fe—B anisotropic magnet powder ($R_2Fe_{14}B$ anisotropic magnet powder produced by hydrogen occlusion/dehydrogenation method, and manufactured by MQI Co. Ltd.) was classified to obtain a magnet powder having particles size of 80–150 μm. A powder mixture of 88 parts by weight of the magnet powder and 12 parts by weight of $CaF_2$ powder was compacted to form a green body under 6000 kgf/cm$^2$ while applying a transverse magnetic field of 10 kOe. After introducing the green body in a graphite mold, the atmosphere in the mold was evacuated to $6\times10^{-3}$ Torr. A pulse current (750 A) was allowed to pass through the green body for 40 seconds at 40 V to activate the powder particles while applying a compressive pressure of 500 kgf/cm$^2$ to the green body. The activated powder was heated at an increasing rate of 2° C./s by passing a DC current of 300 A. The magnetic properties and resistivity of the high-resistance rare earth magnet are shown in Table 7.

TABLE 7

| Compound | Br (kG) | iHc (kOe) | Resistivity (Ω · cm) |
|---|---|---|---|
| $CaF_2$ | 8.3 | 14.0 | $1.0 \times 10^{-3}$ |

Figure 2:
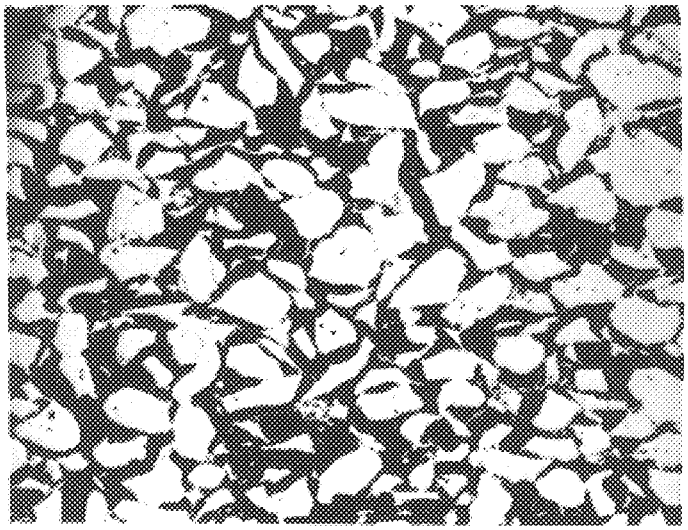

An electron microscope photograph showing the metal structure of the high-resistance rare earth magnet is shown in FIG. 2. In FIG. 2, the black background is the compound phase and the white portions are the magnet phases. It can be seen that the white magnet phases are well dispersed throughout the black compound phase.

EXAMPLE 8

An alloy A having a composition of $Sm_{25}Co_{bal}Fe_{17}Cu_{5.2}Zr_{2.7}$ (weight %) and an alloy B having a composition of $Sm_{23}Co_{bal}Fe_{20}Cu_{5.2}Zr_{2.0}$ (weight %) were prepared by a high-frequency melting.

After coarsely pulverized in a jaw crusher, the alloy A was finely pulverized in a jet mil to obtain a magnet powder having an average particle size of about 5 μm. 75 parts by weight of the magnet powder was mixed with 25 parts by weight of $CaF_2$ powder to obtain a powder mixture, which was then compacted to from a green body under 4000 kgf/cm$^2$ in a transverse magnetic field of 10 kOe. The green body was sintered in vacuo at 1200° C. for 2 hours, and subjected to a solution treatment at 1160° C. for 4 hours and an aging treatment at 780° C. for 24 hours to obtain a high-resistance rare earth magnet.

Separately, after subjected to a solution treatment at 1140° C. for 24 hours and a subsequent aging treatment at 820° C. for 12 hours, the alloy B was coarsely pulverized in a jaw crusher and finely pulverized in Brawn mil to prepare a magnet powder having a particle size of 200 μm or less. 75 parts by weight of the magnet powder was mixed with 25 parts by weight of $CaF_2$ powder to obtain a powder mixture, which was then compacted to from a green body in the same manner as above. The green body was subjected to a spark plasma sintering, hot press and HIP at 800° C. under a pressure of 1000 kgf/cm$^2$ for the spark plasma sintering and hot press or $10^5$ Pa for the HIP to obtain each high-resistance rare earth magnet.

The magnetic properties and resistivity of each high-resistance rare earth magnet and a conventional $R_2Co_{17}$ sintered magnet containing no resistance-increasing compound are shown in Table 8.

TABLE 8

| Production Method | Alloy | Br (kG) | iHc (kOe) | Resistivity (Ω · cm) |
|---|---|---|---|---|
| Vacuum sintering | A | 7.1 | 16.5 | $1.20 \times 10^{-3}$ |
| Spark plasma sintering | B | 9.2 | 17.2 | $5.40 \times 10^{-3}$ |
| Hot press | B | 8.8 | 16.6 | $3.50 \times 10^{-3}$ |
| HIP | B | 9.2 | 17.4 | $2.80 \times 10^{-3}$ |
| Conventional magnet | — | 10.8 | 17.8 | $6.0 \times 10^{-5}$ |

As seen from Table 8, the electrical resistance of the magnet of the present invention is much higher than that of the conventional magnet.

EXAMPLE 9

To a powdery mixture containing $SmF_3$, $CeF_4$, Fe, Co, Cu—Zr and Cu, was added a predetermined amount of $CaH_2$ to prepare 1 kg powder mixture. The powder mixture was heated at 1180° C. for 5 hours in Ar gas atmosphere to obtain a solid product which was a mixture consisting of a $R_2Co_{17}$ magnet having a composition of $Sm_{18}Ce_5Co_{bal}Fe_{13}Cu_{5.5}Zr_{2.6}$ by weight %, and $CaF_2$. The solid product was disintegrated and pulverized to obtain a magnet powder. To the magnet powder, was added and mixed each amount of $CaF_2$ powder so that the amount of $CaF_2$ in the resultant mixture was 15, 20, 25, 30 and 35 weight %. The mixture was then compacted in a transverse field and subjected to a spark plasma sintering at 800° C. The sintered product was further subjected to a solution treatment and an aging treatment in the same manner as in Example 8 to produce each high-resistance rare earth magnet. The magnetic properties and resistivity are shown in Table 9.

TABLE 9

| Amount of $CaF_2$ (weight %) | Br (kG) | iHc (kOe) | Resistivity (Ω · cm) |
|---|---|---|---|
| 15 | 9.2 | 13.5 | $9.70 \times 10^{-4}$ |
| 20 | 8.8 | 13.2 | $1.50 \times 10^{-3}$ |
| 25 | 8.1 | 13.4 | $2.10 \times 10^{-3}$ |
| 30 | 7.8 | 13.8 | $6.80 \times 10^{-3}$ |
| 35 | 7.2 | 13.2 | $1.02 \times 10^{-2}$ |

Figure 3:
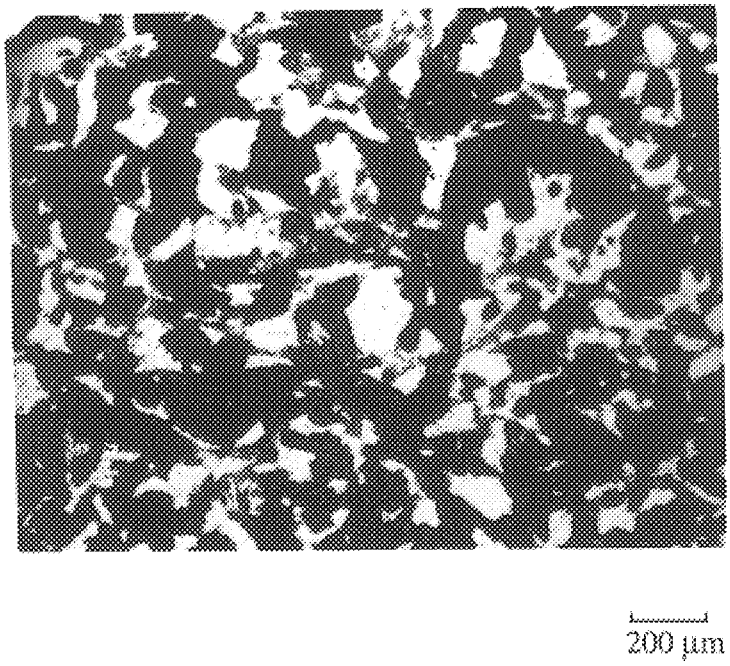

An electron microscope photograph showing the metal structure of the high-resistance rare earth magnet containing 15 weight % of $CaF_2$ is shown in FIG. 3. In FIG. 3, the black background is the compound phase and the white portions are the magnet phases. It can be seen that the white magnet phases are well dispersed throughout the black compound phase.

EXAMPLE 10

To a powdery mixture containing $SmF_3$, $NdF_3$, $PrF_3$, Fe, Co, Fe—Zr and Cu, was added a predetermined amount of $CaH_2$ to prepare 1 kg powder mixture. The powder mixture was heated at 1180° C. for 6 hours in Ar gas atmosphere to obtain a solid product which was a mixture consisting of a $R_2Co_{17}$ magnet having a composition of $Sm_{13}Nd_8Pr_4Co_{bal}Fe_{12}Cu_{5.7}Zr_{2.6}$ by weight %, and $CaF_2$. The solid product was disintegrated and pulverized to obtain a magnet powder. To the magnet powder, was added NaF, $MgF_2$, $CaF_2$, $BaF_2$ or $SrF_2$ in an amount so that the amount of the powder was 10 weight % based on the total amount of the resultant mixture. Each of the mixture was then compacted in a transverse field and subjected to a spark plasma sintering at 800° C. The sintered product was further subjected to a solution treatment and an aging treatment in the same manner as in Example 8 to produce each high-resistance rare earth magnet. The magnetic properties and resistivity are shown in Table 10.

TABLE 10

| Compound | Br (kG) | iHc (kOe) | Resistivity (Ω · cm) |
|---|---|---|---|
| NaF | 7.9 | 12.5 | $1.68 \times 10^{-3}$ |
| $MgF_2$ | 8.2 | 13.2 | $1.50 \times 10^{-3}$ |
| $CaF_2$ | 8.1 | 13.4 | $2.20 \times 10^{-3}$ |
| $BaF_2$ | 7.8 | 14.8 | $1.10 \times 10^{-3}$ |
| $SrF_2$ | 7.2 | 14.2 | $1.25 \times 10^{-3}$ |

From Table 10, it can be seen that the fluorides are effective for increasing the electrical resistance of rare earth magnet, and $CaF_2$ and $SrF_2$ are particularly preferable because these compounds do not react with the constituents of rare earth magnet.

EXAMPLE 11

An alloy having a composition of $Sm_{23}Co_{bal}Fe_{21}Cu_6Zr_2$ produced by a high-frequency melting was subjected to a solution treatment at 1170° C. for 4 hours and an aging treatment at 800° C. for 24 hours, followed by cooling at a cooling rate of 0.7° C./min. The alloy thus treated was coarsely pulverized in a jaw crusher and finely pulverized in Brawn mil to obtain a magnet powder having an average particle size of 31 $\mu$m. 70 parts by weight of the magnet powder was mixed with 20 parts by weight of $CaF_2$ and 10 parts by weight of wollastonite, $Al_2O_3$ or $SiO_2$. The powder mixture was then compacted in a transverse magnetic field and subjected to a spark plasma sintering at 750° C. to produce a high-resistance rare earth magnet. The magnetic properties and resistivity are shown in Table 11.

TABLE 11

| Compound | Br (kG) | iHc (kOe) | Resistivity (Ω · cm) |
|---|---|---|---|
| wollastonite | 7.8 | 13.5 | $1.61 \times 10^{-3}$ |
| $Al_2O_3$ | 6.2 | 12.2 | $1.06 \times 10^{-3}$ |
| $SiO_2$ | 6.1 | 11.4 | $1.11 \times 10^{-3}$ |

As described above, the rare earth magnet of the present invention added with at least one of fluorides and oxides of Li, Na, Mg, Ca, Ba and Sr has a high electrical resistance ranging from $5.0\times10^{-4}$ to $5.0\times10^{-2}$ Ω.cm as well as high magnetic properties such as a residual magnetic flux density of 4–10 kG and a coercive force of 10–20 kOe. The high-resistance rare earth magnet of the present invention therefore exhibits a high energy efficiency when used in a rotary equipment, etc.

What is claimed is:

1. A high-resistance rare earth magnet comprising an R—Fe—B-based magnet phase wherein R is at least one rare earth element including Y and a compound phase comprising at least one compound selected from the group consisting of fluorides of Li, Na, Mg, Ca, Ba and Sr, said R—Fe—B-based magnet phase being dispersed throughout said compound phase.

2. The high-resistance rare earth magnet according to claim 1, wherein said R—Fe—B-based magnet comprises 10–40 weight % of R, 0.5–5 weight % of B and the balance of Fe, each percentage being based on a total amount of said R—Fe—B-based magnet.

3. The high-resistance rare earth magnet according to claim 2, wherein said R—Fe—B-based magnet further comprises 0–25 weight % of Co, 0–5 weight % of Nb and 0.01–2 weight % of at least one element selected from the group consisting of Al, Ga and Cu.

4. The high-resistance rare earth magnet according to claim 1, wherein said compound forming said compound phase is at least one of $CaF_2$ and $SrF_2$.

5. A high-resistance rare earth magnet comprising an R—Co-based magnet phase wherein R is at least one rare earth element including Y, and a compound phase comprising at least one compound selected from the group consisting of fluorides and oxides of Li, Na, Mg, Ca, Ba and Sr, said R—Co-based magnet phase being dispersed throughout said compound phase.

6. The high-resistance rare earth magnet according to claim 5, wherein said R—Co-based magnet comprises 10–35 weight % of R, 30 weight % or less of Fe, 1–10 weight % of Cu, 0.1–5 weight % of at least one element selected from the group consisting of Ti, Zr and Hf and the balance of Co, each percentage being base on the total amount of said R—Co-based magnet.

7. The high-resistance rare earth magnet according to claim 5, wherein said compound forming said compound phase is at least one of $CaF_2$ and $SrF_2$.

8. A process for producing a high-resistance rare earth magnet according to claim 1, comprising the steps of:

mixing an R—Fe—B-based magnet powder wherein R is at least one rare earth element including Y, with at least one powder selected from the group consisting of powders of fluorides of Li, Na, Mg, Ca, Ba and Sr;

compacting the resultant powder mixture to form a green body; and subjecting said green body to a sintering.

9. The process according to claim 8, wherein said R—Fe—B-based magnet comprises 10–40 weight % of R, 0.5–5 weight % of B and the balance of Fe, each percentage being based on a total amount of said R—Fe—B-based magnet.

10. The process according to claim 8, wherein said R—Fe—B-based magnet further comprises 0–25 weight % of Co, 0–5 weight % of Nb and 0.01–2 weight % of at least one element selected from the group consisting of Al, Ga and Cu.

11. The process according to claim 8, wherein said fluoride is at least one of $CaF_2$ and $SrF_2$.

12. A process for producing a high-resistance rare earth magnet according to claim 5, comprising the steps of:

mixing an R—Co-based magnet powder wherein R is at least one rare earth element including Y, with at least one powder selected from the group consisting of powders of fluorides and oxides of Li, Na, Mg, Ca, Ba and Sr;

compacting the resultant powder mixture to form a green body; and subjecting said green body to a sintering.

13. The process according to claim 12, wherein said R—Co-based magnet comprises 10–35 weight % of R, 30 weight % or less of Fe, 1–10 weight % of Cu, 0.1–5 weight % of at least one element selected from the group consisting of Ti, Zr and Hf and the balance of Co, each percentage being based on the total amount of said R—Co-based magnet.

14. The process according to claim 12, wherein said fluoride is at least one of $CaF_2$ and $SrF_2$.

15. A process for producing a high-resistance rare earth magnet according to claim 1, comprising the steps of:

mixing an R—Fe—B-based magnet powder wherein R is at least one rare earth element including Y, with at least one powder selected from the group consisting of powders of fluorides of Li, Na, Mg, Ca, Ba and Sr; and subjecting the resultant powder mixture to a densifying treatment selected from the group consisting of spark plasma sintering, hot press, HIP, extrusion and upsetting work.

16. The process according to claim 15, wherein said R—Fe—B-based magnet comprises 10–40 weight % of R, 0.5–5 weight % of B and the balance of Fe, each percentage being based on a total amount of said R—Fe—B-based magnet.

17. The process according to claim 16, wherein said R—Fe—B-based magnet further comprises 0–25 weight % of Co, 0–5 weight % of Nb and 0.01–2 weight % of at least one element selected from the group consisting of Al, Ga and Cu.

18. The process according to claim 15, wherein said fluoride is at least one of $CaF_2$ and $SrF_2$.

19. A process for producing a high-resistance rare earth magnet according to claim 5, comprising the steps of:

mixing an R—Co-based magnet powder wherein R is at least one rare earth element including Y, with at least one powder selected from the group consisting of powders of fluorides and oxides of Li, Na, Mg, Ca, Ba and Sr; and subjecting the resultant powder mixture to a densifying treatment selected from the group consisting of spark plasma sintering, hot press, HIP, extrusion and upsetting work.

20. The process according to claim 19, wherein said R—Co-based magnet comprises 10–35 weight % of R, 30 weight % or less of Fe, 1–10 weight % of Cu, 0.1–5 weight % of at least one element selected from the group consisting of Ti, Zr and Hf and the balance of Co, each percentage being based on the total amount of said R—Co-based magnet.

21. The process according to claim 19, wherein said fluoride is at least one of $CaF_2$ and $SrF_2$.

* * * * *